United States Patent [19]

Mastronuzzi, Jr.

[11] 4,342,525

[45] Aug. 3, 1982

[54] RETRACTABLE SPEED BUMP

[76] Inventor: Carl T. Mastronuzzi, Jr., 6701 Jefferson Paige Rd., Lot 328, Shreveport, La. 71119

[21] Appl. No.: 180,008

[22] Filed: Aug. 21, 1980

[51] Int. Cl.[3] ..... E01F 13/00

[52] U.S. Cl. ..... 404/6; 49/131

[58] Field of Search ..... 404/6, 9, 15, 11; 49/131; 116/63 P

[56] References Cited

U.S. PATENT DOCUMENTS

| | | | |
|---|---|---|---|
| 1,497,093 | 6/1924 | Doyle | 404/6 X |
| 1,960,376 | 5/1934 | Gilman | 404/6 |
| 1,994,027 | 3/1935 | Poston | 404/11 |
| 3,134,184 | 5/1964 | Neblett | 404/11 X |
| 3,266,013 | 8/1966 | Schmidt | 404/6 X |
| 3,530,775 | 9/1970 | Bowersox | 404/11 |
| 4,012,156 | 3/1977 | Turner | 404/15 |

*Primary Examiner*—Nile C. Byers, Jr.

*Attorney, Agent, or Firm*—John M. Harrison

[57] ABSTRACT

A retractable speed bump mounted in a street, road or roadway for controlling the speed of vehicles, which includes a generally rectangularly-shaped encasement containing upper and lower, relatively movable, wedge-shaped members slidably fitted in the encasement and configured to cooperate by means of friction-reducing means such as ball bearings in adjacent, inclined faces to selectively raise the top of the upper member above street or road level responsive to activation of a hydraulic cylinder attached to the encasement and the lower member.

3 Claims, 4 Drawing Figures

RETRACTABLE SPEED BUMP

BACKGROUND OF THE INVENTION

1. Field of the Invention

This invention relates to a means for controlling the speed of vehicles in selected zones such as school and hospital zones, and more particularly, to a retractable speed bump which is mounted in the road, street or roadway and is operable to selectively raise and lower a cap member or block above street level by means of an internally mounted hydraulic cylinder to provide an impediment to the rapid movement of a vehicle over the roadway. The speed bump is designed to present an elevated, square or rectangularly-shaped obstacle which projects above the surface of the road or street to cause severe bumping or jolting of a vehicle when the vehicle tires strike the obstacle at a high rate of speed. The retractable speed bump of this invention may be remotely controlled, and in a preferred embodiment, is characterized by a generally rectangular encasement which is recessed in the road surface and contains upper and lower wedge-shaped members which slidably cooperate along inclined planes of contact with each other and with the floor and walls of the encasement by means of friction-reducing means such as ball bearings. The wedge-shaped members are relatively movable by operation of a hydraulic cylinder attached to the encasement wall and the lower wedge-shaped member to effect raising and lowering of the top portion of the upper member above the surface of the roadway. The retractable speed bump of this invention can be constructed of any width and length necessary to accommodate substantially any road, street or roadway, and may be installed as a single entity or as multiple assemblies, depending upon the extent of traffic control desired.

2. Description of the Prior Art

Prior art devices for controlling speed of traffic in selected zones are varied in design. Typical of such devices is the "Pop Up Traffic Divider" disclosed in U.S. Pat. No. 3,530,775 to Joseph W. Bowersox. The traffic divider featured in this patent includes a housing which is buried flush with the highway and contains a casing having a column supported on the casing bottom and flush with the highway at the top. An annular piston is disposed between the casing and the column and is moved up and down by differential pressure of fluid such as air. A resilient, deformable tube is mounted on the piston and is retracted within, and expelled from the casing by movement of the piston. The upper end of the column and the casing present a rounded body or bodies, over which the extended, deformable and resilient tube can be bent without injury. Another device which is desiged to be selectively raised and lowered in the roadway is the "Roadway Safety Device" disclosed in U.S. Pat. No. 3,134,184 to E. Neblett. This device is primarily intended to warn of one-way streets and avenues, and includes a hinged plate provided with warning indicia on the side opposite the hinge, with a spring mechanism beneath the hinge to effect raising and lowering of the device with respect to the road surface. Another device for controlling the speed of vehicular traffic is disclosed in U.S. Pat. No. 3,720,181, to Jack D. Elkins, and is entitled, "Inflatable Warning Device for Roadways." The Elkins device generally comprises an elongated, inflatable warning mechanism which is removably disposed transversely of a roadway during selected periods of time in order to control the speed of vehicles traversing the road. Permanently installed vehicular speed control devices are also known in the prior art, and are typified by U.S. Pat. No. 4,012,156 to William Turner. Mr. Turner's "Retractable Safety Speed Bump" includes an elongated half cylinder, hinged to and normally resting in nested configuration in a half cylinder-shaped receptacle disposed in the surface of the roadway, and adapted to hingedly swing upwardly and rearwardly against the roadway to present a curved protuberance on the surface of the road.

In addition to the mechanical devices disclosed in the above described patents, a commonly used method of controlling the speed of vehicular traffic in certain areas is the use of permanently mounted blocks or projections cemented to the road surface, usually in staggered arrays. While these projections are relatively inexpensive, they are susceptible of being broken and displaced from their anchored position by breaking the bond attaching them to the roadway due to the repetitive loads sustained by multiple contacts with the tires of passing vehicles, and they are not susceptible of being removed during periods of minimum traffic or at times when speed control of passing vehicles is unnecessary. Such devices have therefore frequently become not only an eye sore, but also a nuisance during non-regulatory time periods.

Accordingly, it is an object of this invention to provide a retractable speed bump which can be either manually or automatically and remotely activated to a raised and functional position above the surface of a road, street or roadway when its use is necessary to control the speed of vehicular traffic, and subsequently retracted to an elevation co-extensive with the roadway surface when there is no longer a necessity for controlling the traffic speed.

Another object of this invention is to provide a new and improved retractable speed bump which is automatically or manually controlled by a hydraulic cylinder and includes a pair of wedge-shaped blocks slidably mounted in an encasement and fitted in the road or street to present a smooth, unimpeded extension of the street when in retracted configuration, and a projecting, speed-interrupting surface when in selectively extended configuration.

Another object of this invention is to provide a permanently-mounted, retractable speed bump which is normally recessed in the surface of a roadway, road or street requiring vehicular traffic control, and which is characterized by a hydraulic cylinder, the cylinder or base of which is mounted in an encasement or pit, and piston of which is attached to a lower wedge-shaped block which interferes with an upper, upwardly extending block along matching, inclined faces, wherein a portion of the upper block is caused to project vertically above the road surface when the hydraulic cylinder is activated and the lower block is slidably disposed horizontally away from the cylinder base.

Yet another object of this invention is to provide a new and improved retractable speed bump which can be mounted in recessed fashion in an enclosure or pit in the roadway, road or street surface, and which includes a bottom block having an upward standing inclined face and resting on the bottom of the enclosure or pit, and a top block having a matching, downwardly facing inclined face and carried by the bottom block, and at least one hydraulic cylinder mounted in one wall of the enclosure and having a piston cooperating with the bottom block to effect horizontal slidable displacement of the bottom block in the enclosure and vertical movement of the top block upwardly from a position normally in registration with the street surface to a position with a portion of the top block projecting above the street surface.

A still further object of the invention is to provide a retractable speed bump mounted in a roadway for controlling the speed of vehicles, which includes a generally rectangularly-shaped encasement containing upper and lower, relatively movable, wedge-shaped members slidably fitted in the encasement and configured to cooperate by means of friction-reducing means, such as ball bearings, in adjacent, inclined faces to selectively raise the top of the upper member above street or road level responsive to activation of a hydraulic cylinder attached to the encasement and the lower member.

SUMMARY OF THE INVENTION

These and other objects of the invention are provided in a retractable speed bump characterized by a generally rectangular-shaped encasement carrying the base of at least one hydraulic cylinder in transverse relationship, a wedge-shaped bottom block slidably positioned in the encasement, and a wedge-shaped top block supported by the bottom block along inclined faces, and disposed for relative movement vertically responsive to activation of the hydraulic cylinder and horizontal displacement of the bottom block in the encasement.

BRIEF DESCRIPTION OF THE DRAWING

The invention will be better understood by reference to the accompanying drawing, wherein.

DESCRIPTION OF THE PREFERRED EMBODIMENTS

Figure 1:
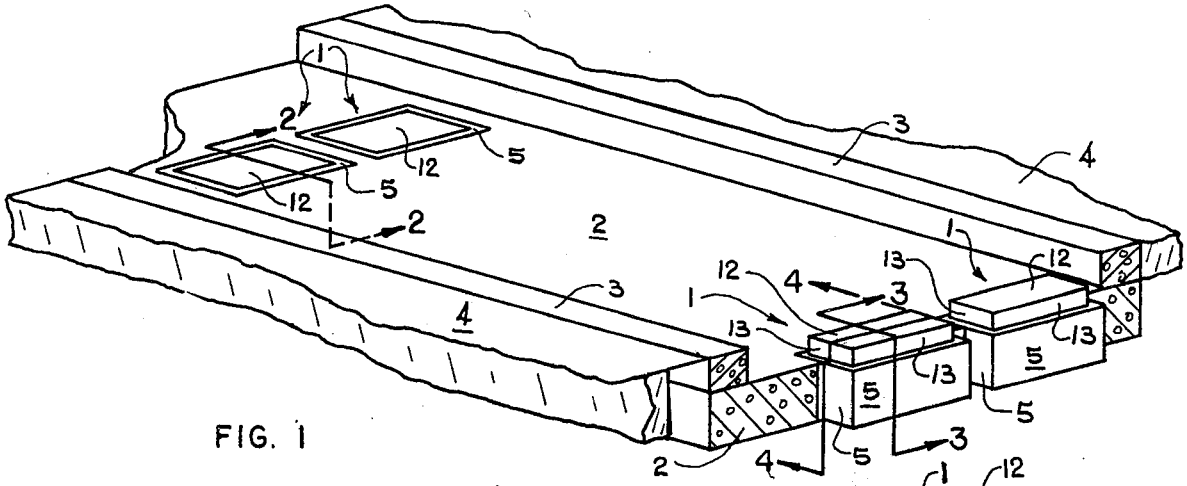
FIG. 1 is a perspective view, partially in section, of a section of road or street having four assemblies of the retractable speed bump of this invention installed therein.

Referring to FIG. 1 of the drawing, the retractable speed bump of this invention is generally illustrated by reference numeral 1, and a pair of the speed bumps are shown installed in retracted configuration at the extreme left of FIG. 1, in street 2. A curb 3 is illustrated at the edges of street 2, and a shoulder 4 extends from each curb 3, as illustrated. Retractable speed bump 1 includes a generally rectangular-shaped encasement 5, having four sides and a bottom, and further includes a cap block 6, which slidably registers with the top opening in encasement 5 to facilitate the desired traffic control feature. Speed control of passing traffic is achieved by the projection of cap block top 12 and cap block shoulders 13 of cap block 6 above the surface of street 2 to engage the tires of motor vehicles traversing the street 2.

Figure 2:
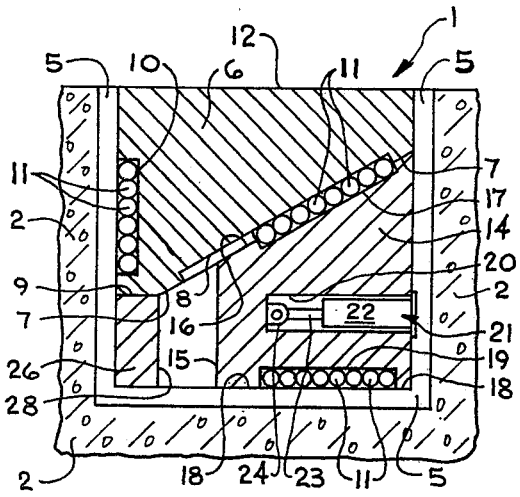
FIG. 2 is a sectional view taken along lines 2—2 in FIG. 1, more particularly illustrating the components of the retractable speed bump in retracted configuration.

Referring now to FIG. 2 of the drawing, in a preferred embodiment of the invention the cap block 6 is shaped to define a cap block incline 7, extending from a cap block base 9 upwardly, and grooved to form a cap block incline slot 8, as illustrated. Cap block 6 is also provided with a cap block vertical slot 10 opposite the cap block incline slot 8, and a quantity of ball bearings 11 are fitted into cap block vertical slot 10 to reduce friction between cap block 6 and the vertical wall of encasement 5 adjacent cap block vertical slot 10. When retractable speed bump 1 is illustrated in normally retracted configuraton as illustrated in FIG. 2, cap block base 9 of cap block 6 rests on the top surface 27 of a stop block 26, secured to the corner of encasement 5 beneath cap block 6. The top segment of cap block incline 7 in cap block 6 rests on a wedge block incline 16, on wedge block 14, the latter of which is disposed beneath cap block 6, and is normally spaced from stop block 26. Wedge block 14 slidably cooperates with cap block 6 by means of wedge block incline slot 17, provided in wedge block incline 16, and adjacent and parallel to cap block incline slot 8, and ball bearings 11, disposed in wedge block incline slot 17 and cap block incline slot 8. In order to facilitate a friction-free horizontal movement of wedge block 14 toward stop block 26 in encasement 5, a wedge block base slot 19 is provided in wedge block base 18 of wedge block 14, and additional ball bearings 11 are fitted in the slot, as illustrated. At least one horizontal cylinder aperture 20 is provided in wedge block 14, depending upon the required length of retractable speed bump 1 and encasement 5, as hereinafter described. A piston bracket 24 is mounted to the end of cylinder aperture 20, and carries the cylinder piston 23 of a hydraulic cylinder 21. Cylinder piston 23 cooperates with the cylinder base 22 of hydraulic cylinder 21, and the cylinder base 22 is securely mounted to a vertical wall of encasement 5, as illustrated. Accordingly, operation of hydraulic cylinder 21 includes extension and retraction of cylinder piston 23 with respect to cylinder base 22 to effect sliding, horizontal movement of wedge block 14 on ball bearings 11 in encasement 5, as hereinafter described.

Figure 3:
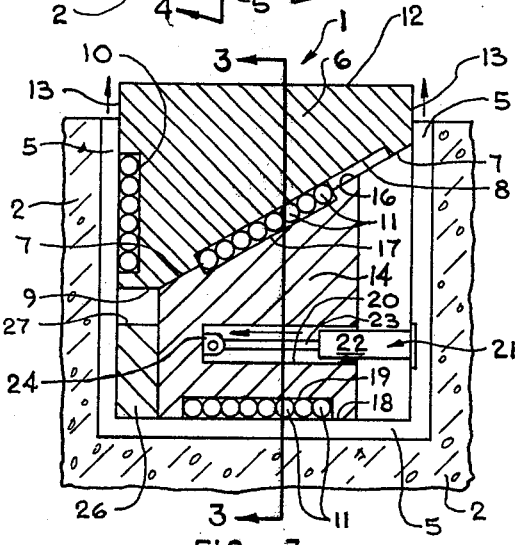
FIG. 3 is a sectional view taken along lines 3—3 in FIG. 1, more particularly illustrating the retractable speed bump in extended configuration.

Referring now to FIG. 3 of the drawing, when it is desired to extend the retractable speed bump 1, hydraulic cylinder 21 is activated either by remote control or by appropriately located valves in the area of the retractable speed bumps to effect an extension of cylinder piston 23 with respect to cylinder base 22, and a sliding movement of wedge block 14 horizontally in the direction of the arrow. This repositioning of wedge block 14 effects an upward thrust on cap block 6 due to the relative movement of wedge block incline 16 and cap block incline 7 on ball bearings 11, positioned in cap block incline slot 8 and wedge block incline slot 17, which projects cap block 6 upwardly in the direction of the vertical arrows to expose cap block top 12 and cap block shoulders 13 above the surface of street 2. Wedge block 14 continues in sliding displacement inside encasement 5 until wedge block face 15 contacts side surface 28 of stop block 26, to project cap block 6 above street 2 to the desired extent. When it is desired to retract cap block 6 back into encasement 5, the action of hydraulic cylinder 21 is reversed, and cylinder piston 23 retracts in cylinder base 22 to force wedge block 14 rearwardly, and the retractable speed bump 1 assumes the configuration illustrated in FIG. 2. Alternatively, hydraulic cylinder 21 may be characterized as a single action cylinder, and when hydraulic pressure is released from cylinder base 22, the weight of cap block top 12 causes wedge block 14 to slide horizontally back to its original position as illustrated in FIG. 2.

It will be appreciated by those skilled in the art that the retractable speed bump of this invention can be constructed of substantially any desired size to accommodate the width and travel area of substantially any roadway, road or street. Furthermore, any number of units can be utilized in cooperation, as illustrated in FIG. 1, to effectively control the speed of vehicular traffic in zones where such control is only periodically necessary. For example, in such areas as school zones where the speed of traffic must be closely controlled during school hours, the retractable speed bump can be extended for the desired length of time and subsequently retracted when children are no longer on the premises or in the area.

Figure 4:
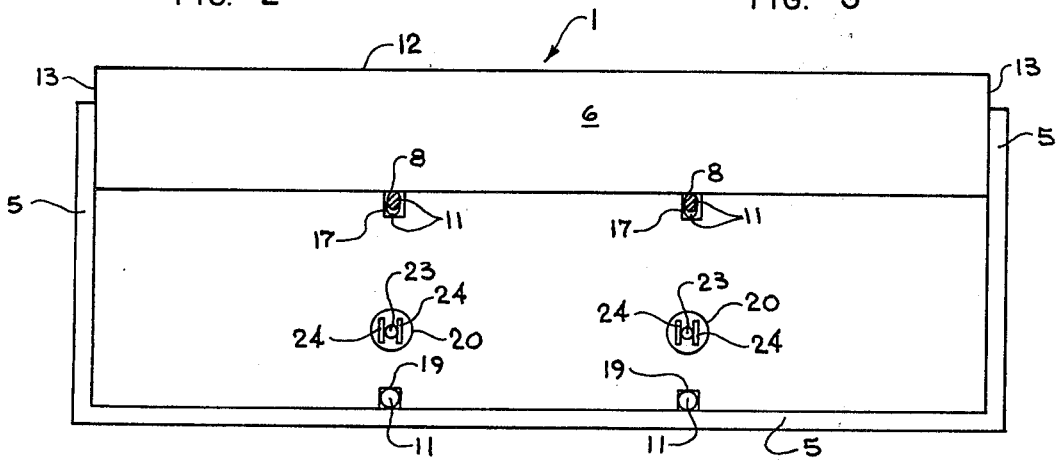
FIG. 4 is a sectional view taken along lines 4—4 in FIG. 1, and lines 3—3 FIG. 3 also illustrating the retractable speed bump in extended configuration.

It will be further appreciated by those skilled in the art that in the event a relatively elongated retractable speed bump 1 is required for any desired application, multiple cap block incline slots 8, and cooperating wedge block incline slots 17, cap block vertical slots 10, and wedge block base slots 19, each fitted with ball bearings will be necessary in parallel relationship, respectively, as illustrated in FIG. 4 of the drawing. Multiple hydraulic cylinders 21 may also be mounted in the encasement 5 as also illustrated in FIG. 4, to provide a stable and smoothly operating system over the selected span of the encasement 5. In a most preferred embodiment of the invention encasement 5 is fitted with a pair of cap block vertical slots 10, cap block incline slots 8 and cooperating wedge block incline slots 17, and wedge block base slots 19, with accompanying ball bearings 11, in substantially parallel relationship respectively, as illustrated in FIG. 4, to balance the retractable speed bump assembly 1.

The retractable speed bump of this invention is characterized by durability and strength, in that the hydraulic cylinder 21 or cylinders is not directly exposed to impact or pressure loading from passing vehicles. The shock of contact between the vehicle tires and the speed bump device is carried by cap block 6 and wedge block 14, and hydraulic cylinder 21 is insulated from this shock. Furthermore, ball bearings 11 are fitted into the various sealed slots with minimum contact with dirt and grime in order to insure maximum efficiency and minimum maintenance in retraction and extension of the device over a long period of time.

It will be further appreciated by those skilled in the art that alternative friction-reducing means, including rollers and the like can be provided in cap block incline 7 and wedge block incline 16, and in the vertical face of cap block 6 and wedge block base 18 to aid smooth relative movement of cap block 6 and wedge block 14 inside encasement 5. Furthermore, both cap block 6 and wedge block 14 may be shaped from a hard durable rock such as granite, or the members may be fabricated of iron or steel, as deemed necessary for any anticipated installation. Encasement 5 may likewise be shaped by excavating a pit in the street or roadway, and reinforced with a metal frame. However, in a preferred embodiment of the invention encasement 5 is shaped and fabricated of metal to facilitate smooth relative movement of cap block 6 and wedge block 14 therein.

Referring again to the drawing, it will be understood that the cap block 6 and wedge block 14 can be moved into the extended configuration by either manual or automatic controls attached to hydraulic cylinder 21, according to the knowledge of those skilled in the art.

Accordingly, having described my invention with the particularity set forth above,

What is claimed is:

1. A retractable speed bump for controlling the speed of vehicles on a roadway comprising an encasement in said roadway; upper and lower, relatively movable, wedge-shaped members slidably fitted in said encasement and movably cooperating along inclined faces; friction-reducing means fitted in said inclined faces of said upper and said lower members, and in the bottom of said lower of said members and in the side of said upper of said members opposite said inclined faces to reduce friction between said upper and said lower members and between said members and said casing; a stop block positioned in said encasement in spaced relationship from said lower of said members and supporting one side of said upper of said members when said speed bump is in retracted configuration; and a single-action hydraulic cylinder positioned in transverse relationship in said encasement, and having a base secured to said encasement and a piston attached to said lower of said members; to selectively slidably displace said lower of said members horizontally in said casing and raise the top of said upper of said members above the surface of said roadway.

2. The retractable speed bump of claim 1 wherein said friction-reducing means is a plurality of ball bearings, and further comprising an opening in said lower of said members in alignment with said hydraulic cylinder to accommodate said hydraulic cylinder when said retractable speed bump is in retracted configuration.

3. A retractable speed bump for controlling the speed of vehicles in a roadway comprising:

(a) an encasement having a floor, and side and end walls;

(b) a lower wedge-shaped member having a first inclined plane facing upwardly and slidably dispose on said floor of said encasement, and provided with a transverse opening in the vertical side thereof opposite said first inclined plane;

(c) an upper wedge-shaped member having a second inclined plane facing downwardly and slidably disposed on said first inclined plane of said lower wedge-shaped member;

(d) at least one first slot in said first inclined plane and at least one matching second slot in said second inclined plane opposite said first slot and shorter than said first slot, and at least one wedge block slot in the base of said lower wedge-shaped member, and at least one cap block slot in the side of said upper wedge-shaped member opposite said second inclined plane, and a plurality of ball bearings in said first slot and said matching second slot, and in said wedge block slot and said cap block slot to better facilitate movement of said lower wedge-shaped member and said upper wedge-shaped member in said encasement;

(e) a stop block positioned in said encasement in spaced relationship from said lower wedge-shaped member and supporting one side of said upper wedge-shaped member when said speed bump is in retracted configuration; and (f) at least one single-action hydraulic cylinder having a base mounted on one of said walls of said encasement and a pistion attached to said lower wedge-shaped member inside said transverse opening for selective, slidable displacement of said lower wedge-shaped member horizontally, and slidable displacement of said upper wedge-shaped member along said first inclined plane and said second inclined plane vertically upwardly responsive to activation of said hydraulic cylinder.

* * * * *